US005207763A

United States Patent [19]

Jacobsson

[11] Patent Number: 5,207,763

[45] Date of Patent: May 4, 1993

[54] MONITORING SYSTEM FOR KNITTING MACHINES

[75] Inventor: Kurt A. G. Jacobsson, Ulricehamn, Sweden

[73] Assignee: International Trading S.r.L., Busto Arsizio, Italy

[21] Appl. No.: 779,138

[22] Filed: Oct. 18, 1991

Related U.S. Application Data

[63] Continuation of Ser. No. 411,494, Oct. 10, 1989.

[30] Foreign Application Priority Data

Apr. 15, 1988 [WO] PCT Int'l Appl. ..... PCT/SE88/00196

[51] Int. Cl.[5] ..... D04B 35/10

[52] U.S. Cl. ..... 66/163; 66/157; 371/25.1

[58] Field of Search ..... 37/25.1; 66/157, 163

[56] References Cited

U.S. PATENT DOCUMENTS

| | | | |
|---|---|---|---|
| 4,628,710 | 12/1986 | Jacobsson | 66/163 X |
| 4,720,702 | 1/1988 | Martens | 66/163 X |
| 4,726,025 | 2/1988 | Splett et al. | 371/25.1 |
| 4,744,227 | 5/1988 | Whitener, Jr. et al. | 66/163 |
| 4,773,028 | 9/1988 | Tallman | 371/25.1 X |

FOREIGN PATENT DOCUMENTS

| | | | |
|---|---|---|---|
| 1497279 | 1/1978 | United Kingdom | 66/163 |

*Primary Examiner*—Clifford D. Crowder
*Assistant Examiner*—John J. Calvert
*Attorney, Agent, or Firm*—Beveridge, DeGrandi, Weilacher & Young

[57] ABSTRACT

A monitoring system for knitting machines, in particular for such machines for the knitting of hosiery or socks, having a number of yearn guards allocated to each yarn for infeed into the machine, the guards each being operative, in response to a movement or absence of movement of the yarn, respectively, detected thereby, to generate and output signal to stop the machine in the event of yarn or thread breakage or other fault int h e yarn infeed, by the intermediary of preferably electronic control unit connected to the yarn guards. The control unit includes memory and comparison systems and is arranged to gather and memorize, during an introductory, correct and approved working or report cycle of the machine, information representing the yarn infeed phase in the form of the actual pattern of output signals from the yarn guards. The control unit is further arranged thereafter to compare, during subsequent working or report cycles of the machine, the pattern of output signals thus registered and memorized during the introductory, correct and approved working or report cycle with the actual pattern of output signals registered during the current, subsequent working or report cycle in order, in the event of a discrepancy therebetween, to generate a fault signal for stopping the machine.

3 Claims, 4 Drawing Sheets

MONITORING SYSTEM FOR KNITTING MACHINES

This application is a continuation of application Ser. No. 07/411,494, filed Oct. 10, 1989, now abandoned, and a continuation of PCT Application No. PCT/SE88/00196 having an international filing date of Apr. 15, 1988.

The present invention relates to a monitoring system for knitting machines, in particular for such machines as are intended for the knitting of hosiery or socks, comprising a number of yarn or thread guards associated with each yarn intended for infeed into the machine, the guards each being operative, in response to a movement or absence of movement of the yarn, respectively, detected thereby, to generate an output signal to stop the machine in the event of, for example, yarn or thread breakage or other fault in the yarn infeed, by the intermediary of a preferably electronic control unit connected to the yarn guards.

In certain types of knitting machines such as, for example, automatic hosiery and sock knitting machines, one or more yarns are knitted in parallel in one or more systems and with variable speeds, according to the design and form of the sock. Thus, for example, reinforcements or replacement of yarn type may occur in the gusset rib, heel and toe portions of the sock. To this end, the machines are equipped with a program mechanism, of mechanical, pneumatic or electromechanical type, for controlling yarn carriers with scissors etc.

In order, in an efficient manner, to keep the yarn ends under control on non-working yarns, as well as to take care of any possible yarn remnants, the machines are also equipped with a suction system.

In yarn breakage, for example because the strength of the yarn, weak portions or defective knots have failed to cope with stitch, loop or rib formation, the majority of such breakages takes place in the stitch formation region proper. Normally, the stop-motion devices, which sense the presence of a yarn or thread and are included as standard equipment in all machines, are incapable of detecting this fault, since the yarn, because of the action of the suction system, is still held under sufficient tension. If only one yarn or thread is used, the needle guards will be able to sense unopened needle latches and, this nonwithstanding, stop the machine. However, when several yarns are used in parallel in the same system, it is not possible to detect the fault in this manner, nor is it possible on modern machines with positively controlled needles of the compound type. It is even more difficult to detect the loss of a laid-in yarn, for example, a plush yarn in a sports sock, since the loop formation of the basic yarn is still taking place. As a result, the machine may operate for a considerable time and produce a large number of defective products before the fault is discovered.

In order to solve this problem, it is known in the art to employ conventional motion-sensing yarn or thread guards. However, these must be synchronised with the choice of yarn in the machine. By mounting additional sensors, for example micro-switches, on the yarn carriers or their selector mechanisms, this is possible on many machine makes and machine models, while, on other models this is impossible because of lack of space. Such a solution also requires high quality switches which can cope with the extremely dusty and oily environment and, at the same time, not present an obstacle to operation and service of the main machine. There is a large number of variations of machine make and machine model, and the installation time for wiring is considerable. The design and spares storage for all of these variations are also costly items.

This problem is solved according to the present invention in that said control unit for example, a microcomputer or the like, includes memory and comparison means and is, in such instance, arranged to gather and memorize, during an introductory, correct and approved working or report cycle of the machine information representing the yarn infeed phase in the form of the actual pattern of output signals from said yarn guards, and is further arranged thereafter to compare, during subsequent working or report cycles of the machine, the pattern of output signals thus registered and memorized during the introductory, correct and approved working or report cycle with the actual pattern of output signals registered during the current, subsequent working or report cycle in order, in the event of a discrepancy therebetween, to generate a fault signal for stopping the machine. Said control unit is operative to collect or register the information representing the yarn infeed phase in the form of the pattern of output signals from the yarn guards on the occurrence of a pulse which is generated once per machine revolution by a signal emitter similarly connected to the control unit. A further signal emitter, similarly connected to the control unit and being operative to generate and deliver to the control unit a pulse on the start of each reporting cycle in the machine.

Primarily, the system according to the present invention is characterized in that the above-mentioned motion sensing yarn guard itself is used as a sensor in order, during a registration cycle, to build up a memory bank against which subsequent working cycles may operate. In the event of a discrepancy between the actual pattern of output signals from the above-mentioned sensor and the correct pattern of the output signals registered and memorized during the registration cycle, the system will generate a stop signal to the machine in question.

The system according to the present invention essentially comprises the following components:

- emitter (sensor) for registering yarn motion or absence of yarn motion;
- central unit with memory function;
- emitters for generating one pulse per machine revolution;
- emitters for generating one pulse on each report start.

The operational mode in the system according to the present invention proceeds such that the machine is set at a new working cycle with the stop function of the system de-activated. This entails but a minor drawback, since the machine is still constantly monitored manually at this stage and with ordinary stop functions. After approval of the working cycle, a registration button on the central unit is depressed. The central unit thereafter awaits the first cycle start pulse (report start pulse). Those emitters (sensors) which detect running yarn on the occurrence of each revolution pulse are then registered and memorized in the central unit, this procedure continuing until such time as the next report start pulse occurs. By such means, a memory bank is created in the central unit in the form of a pattern of the yarn consumption or yarn motion sequence during one machine or report cycle.

Hereafter, the system is arranged such that the stop function automatically becomes operative in the event of a discrepancy between the actually registered pattern of output signals from the yarn motion sensors on each revolution pulse and the norm values of sensor signal patterns on each revolution pulse which were memorized in the memory bank of the central unit during the registration cycle.

On the occurrence of faults, when the machine is run to the next report start by a so-called short cycle procedure, there is a reset button on the central unit which disconnects the stop function until the next report start pulse occurs.

The advantages inherent in the system according to the present invention are obvious to the skilled reader:

- installation is considerably facilitated in that only motion sensors, pulse emitters and central unit need by installed, in standarised design for all machine types;
- no adaption of sensors to machine type is required;
- in operational terms, reliability is improved in that fewer elements and parts are employed as compared with prior art systems;
- for the same reason, accessibility is greatly improved for the machine operator;
- all previously know machine types can be served.

An embodiment of the present invention will be described in greater detail below with reference to the accompanying drawings.

The embodiment of the present invention, as illustrated on the drawings, may be applied on a machine for knitting of different types of products, for instance stockings or socks. Each one of the included threads is allocated an emitter which is operative to emit an electric signal on thread movement. Furthermore, the machine is provided with an emitter which is operative to generate an electric signal or flag pulse (designated "FLAG" in FIGS. 1 and 2) and which defines a thread movement sensing period during one machine revolution, which may also be designated a pattern stage or knitting revolution. The term machine revolution may also be taken to refer to a machine cycle. The products which is to be knitted consists of a number of knitting cycles or pattern stages which together form the product and its pattern. The machine also includes an emitter which is operative to generate an electric signal or sync-pulse ("SYNC" in FIGS. 1 and 2) on the commencement of each products, and thereby on the initiation of a new pattern.

Figure 1:
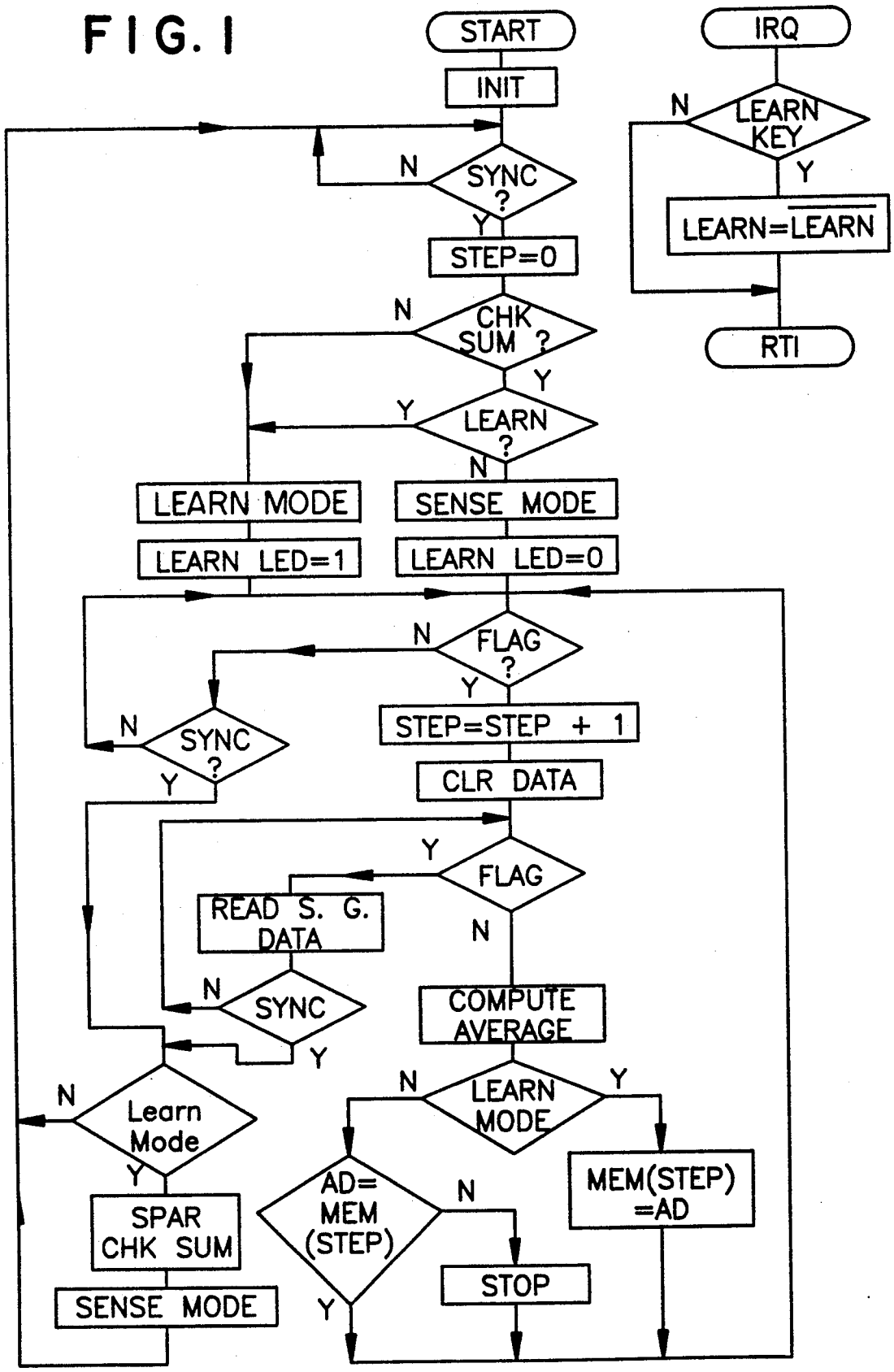
FIG. 1 is a flow diagram of one physical application of the present invention.
Figure 2:
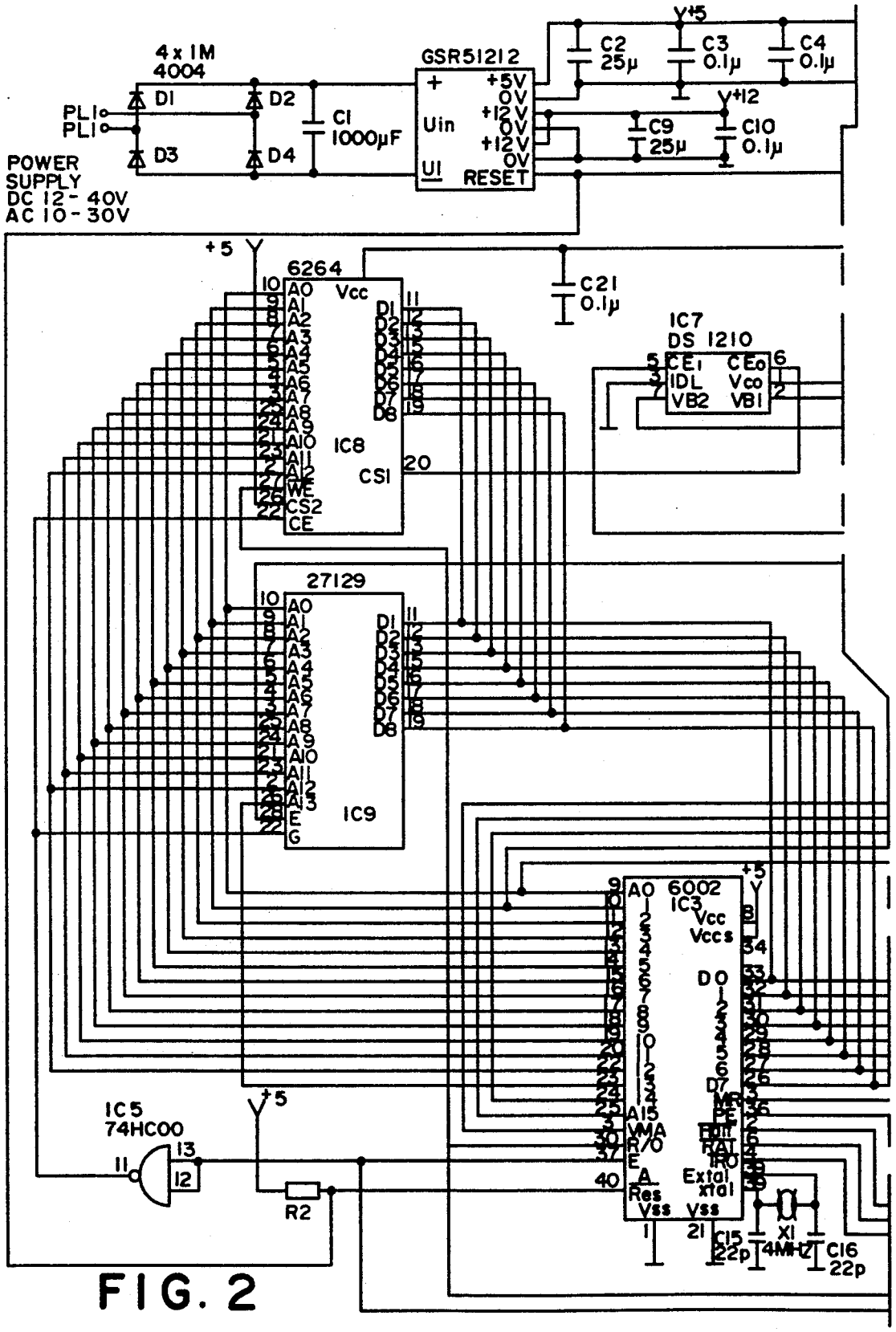
FIGS. 2–4 are block diagrams of one embodiment for carrying out the practical application according to FIG. 1.
Figure 3:
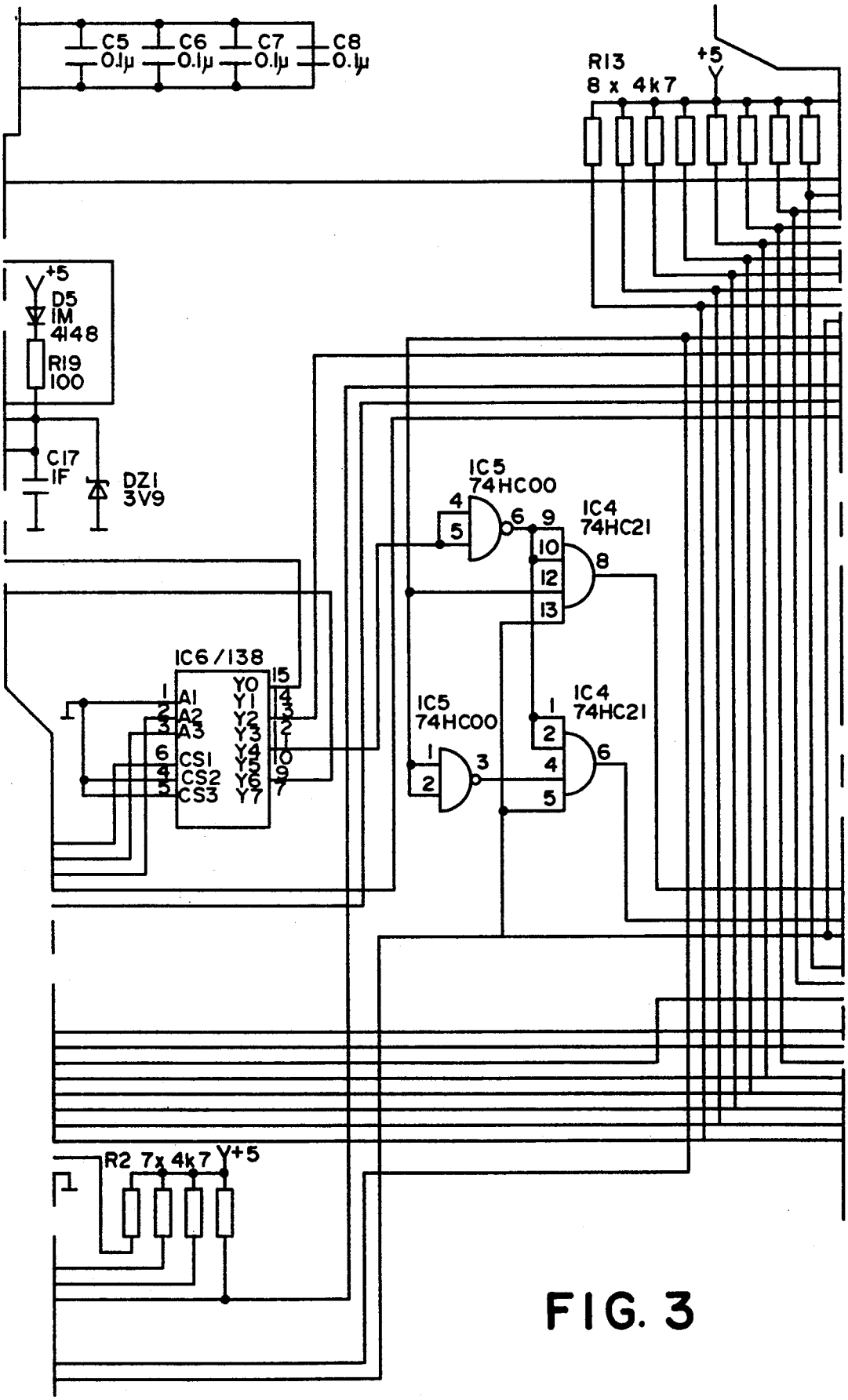
Figure 4:
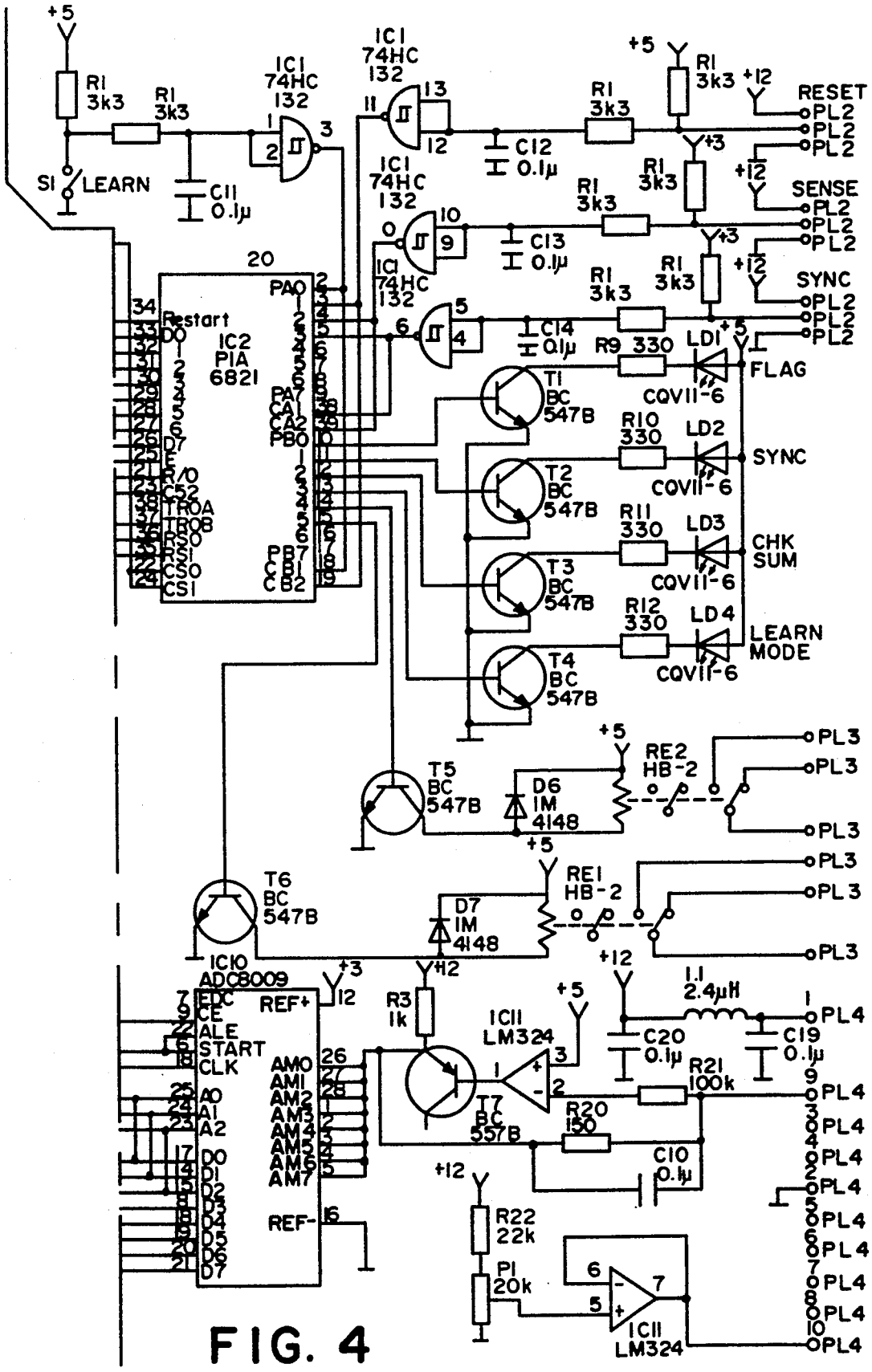

The electronic coupling diagram illustrated in FIG. 2 is, in principle, self-evident to a person skilled in the art and makes it possible for the skilled reader of this specification to reduce into practice an apparatus for monitoring the manufacture of stockings or socks in a knitting machine. Hence, FIG. 2 shows the hardware section, while FIG. 1 illustrates the software section or a flow diagram for the software section, which is also easy to reduce into practice according to generally accepted methods for a person skilled in this art.

The hardware section according to FIG. 2 includes a number of integrated circuits 1–11 which are all currently available on the market. The integrated circuit IC3 is a micro-computer which is controlled by means of a program stored in the integrated circuit IC9 which is a read memory and contains the program requisite for the function of the circuit. The integrated circuit IC8 is a registration or memorization circuit. The integrated circuit IC10 is an AD converter, while the integrated circuit IC2 is both an input and output circuit. The integrated circuit IC7 is a battery back-up circuit for the registration circuit IC8, while the integrated circuit subunits IC4, IC5 and IC6 form decoder units. Otherwise, the symbols in the coupling diagram are of the generally accepted type. A switch S1 is connected to the input and output circuit IC2 for switching the apparatus to and from a learn mode or learn phase. Furthermore, there is connected, to the circuit IC2, a reset button"RESET", which, after actuation, always entails resetting of the electronic circuits an the program to the initial position. There is further coupled-in a sensor circuit "SENS" which receives a flag pulse which determines that period of time during which thread movement is to be sensed in each pattern stage or machine revolution. Moreover, a circuit unit "SYNC" is coupled to the input and output circuit IC2 for entry of a sync-pulse on commencement of each product. There are further connected to the input and output circuit IC2 a number of light emitting diodes (LEDs) LD1–LD4 for indicating the presence of a flag pulse, sync-pulse, check total CHK and learn mode, respectively. There are further coupled to the input and output circuit IC2 two relays RE1 and RE2. On the occurrence of a signal triggering an alarm and/or stop function, the relay RE1 entrains the lighting of an indication lamp or other type of signal emitter, while the relay RE2 entails stop of the machine.

All thread movement signal emitters are of the current emitter type and are installed on the machine in per se known way to be actuated by the threads at least when they are moving, are coupled in parallel and to the AD converter IC10 via the connection points 9P14, 2P14 and 10P14. The more threads there are in movement on each sensing, the greater will be the signal to the AD converter, and the lesser will be the digital signal departing from the AD converter, which digital signal may have a value from 0 to 255. The sensitivity of the signal emitters may be regulated by the integrated circuit IC11 and the potentiometer P1 and is supplied by the circuit connected to the connection point 10P14.

Taking the flow diagram in FIG. 1 as the point of departure, the operational mode of the above-described circuitry will be described. Apart from the major flow from "START" to "STOP", or the next pattern stage, there is also an "INTERRUPT" flow which is made operative on the intentional desire for a learn phase which is initiated on every second depression of the current switch or switch S1 in FIG. 2. How the learn phase proceeds is apparent in the major flow. When current has been turned on and a number of initial coupling checks have been executed, the apparatus waits for a sync-pulse, which is the start pulse proper.

As soon as a sync-pulse occurs, it is ascertained that the pattern stage 0 has been introduced. On condition that the check total is correct, it is queried whether there is to be carried out a learn phase or a normal sensing phase. Prior to the commencement of a completely new product, for example a sock, a learn phase must, naturally, always be carried out, in which the light emitting diode LD4 is lit. Irrespective of whether the apparatus is in its learn mode or sensing mode, during which latter the light emitting diode LD4 is extinguished, the apparatus awaits a flag pulse which entails that pattern stage 1 has been commenced and CLRDATA cleared, the registration circuit or memory circuit IC8 (the computer circuits) are zeriozed. As long as there is a flag pulse, the signal from the AD converter IC10 is read at very short intervals, eg 100 microseconds and these readings are stored or registered in the memory circuit IC8. When the flag pulse disappears and the pattern stage and machine revolution have been completed, the mean value of the read-offs executed during the pulse flag is calculated and, if the apparatus is in the learn mode (LEARN), the resultant mean value is registered. If, on the other hand, the apparatus is in the sensing mode, the thus resultant mean value is compared with the value previously memorized during a learn phase of the signal in the pattern stage under consideration. If the difference between the mean value arrived at during the sensing operation does not deviate by more than a certain predetermined number of units from the memorized value, the apparatus passes to the next pattern stage, but if the deference is greater, a signal which triggers an alarm or stop function is generated, whereby the relays RE1 and RE2 are energized. After the finish of a complete product or a complete sock, which is approved after inspection, there will be, in the registration or memory circuit IC8, a signal value for each machine revolution which is, in the sensing mode (SENSE), to be compared with the calculated mean value of the sensed signal on normal running operation.

While FIG. 1 illustrates an automatic switching to the learn mode if the check total is incorrect, it is difficult, in most cases, to carry out an automatic learn mode run. If the check total is incorrect, this should lead to a signal triggering an alarm and/or stop function. In principle, all learn mode runs must be monitored and the subsequently finished product must be inspected before switching to the sensing mode is executed.

After running of a learn phase or learn mode and approval of the thus produced product, the signals for each pattern stage are stored in the registration or memory circuit IC8 and the machine may be run for manufacture of identical products for several days, several weeks or several months, without the necessity of implementing a new learn phase.

Thus, in every machine revolution there may be included any given number of threads of yarns, and also threads or yarns of different types, since the apparatus senses every machine revolution and ascertains whether the thread movements sensed during the manufacturing operation give a signal in the present machine revolution which had previously been obtained with a so-called master sock or the first-manufactured sock, or the sock produced during the learn phase. Since, in every machine revolution, an immense number of sensing operations is carried out, and since it is preferably the mean value of all sensings which is compared with the previously memorized signal, certain deviations in the signal are permitted without therefore giving rise to machine stop.

When reading the appended claims in relation to the above-illustrated practical application of the present invention, the term a plurality of mutually subsequent signals will be understood as the signal from one and the same pattern stage is mutually subsequent products, but it may, naturally, just as well relate to signals from several mutually subsequent pattern stages in the same product, when the pattern stages are alike and the registered signals for each respective pattern stage are substantially alike or do not differ from one another more than by the predetermined number of units permitted between registered signal and sensed signal, i.e. the calculated mean value of a number of sensings of one and the same signal. Every working or report cycle may include one or several machine revolutions or all the machine revolutions necessary to obtain a complete sock or stocking. Further a pattern step may include one or several machine revolutions and a sock or stocking may include one or several pattern steps.

I claim:

1. A monitoring system for knitting machines as are intended for the knitting of hosiery or socks, comprising an number of yarn or thread guards associated with each yarn intended for infeed into the machine, the guards each being operative, in response to a movement or absence of movement of the yarn, respectively, detected thereby, to generate an output signal to stop the machine in the event of yarn or thread breakage or other fault in the yarn infeed, by the intermediary of an electronic control unit connected to the yarn guards, wherein said control unit includes memory and comparison means and is arranged to gather and memorize, during an introductory, correct and approved working or report cycle of the machine, information representing the yarn infeed phase in the form of the actual pattern of output signals from said yarn guards, and is further arranged thereafter to compare, during subsequent working or report cycles of the machine, the pattern of output signals thus registered and memorized during the introductory, correct and approved working or report cycle with the actual pattern of output signals registered during the current, subsequent working or report cycle in order, in the event of a discrepancy therebetween, to generate a fault signal for stopping the machine.

2. The monitoring system as claimed in claim 1, wherein said control unit is operative to collect or register the information representing the yarn infeed phase in the form of the pattern of output signals from the yarn guards on the occurrence of a pulse which is generated once per machine revolution by a signal emitter similarly connected to the control unit.

3. The monitoring system as claimed in claim 1, wherein a further signal emitter, similarly connected to the control unit and being operative to generate and deliver to the control unit a pulse on the start of each reporting cycle in the machine.

* * * * *